US006688941B1

(12) United States Patent
Hooten

(10) Patent No.: US 6,688,941 B1
(45) Date of Patent: Feb. 10, 2004

(54) WHIRLING STREAMER SNAKE TOY

(76) Inventor: Patricia See Hooten, 2721 Shades Crest Rd., Birmingham, AL (US) 35216

( * ) Notice: Subject to any disclaimer, the term of this patent is extended or adjusted under 35 U.S.C. 154(b) by 0 days.

(21) Appl. No.: 10/170,158

(22) Filed: Jun. 12, 2002

(51) Int. Cl.[7] ..... A63H 1/24; A63H 1/28
(52) U.S. Cl. ..... 446/242; 446/236
(58) Field of Search ..... 446/236, 215, 446/247, 266, 397, 490, 68, 61, 242; 40/586

(56) References Cited

U.S. PATENT DOCUMENTS

| | | | | | |
|---|---|---|---|---|---|
| 1,966,895 | A | * | 7/1934 | Kuhns | 446/247 |
| 2,004,817 | A | | 6/1935 | Linney | |
| 2,420,287 | A | | 5/1947 | Linney | |
| 2,525,221 | A | | 10/1950 | Hinsen | |
| 2,979,858 | A | | 4/1961 | Holman, Jr. | |
| 3,082,571 | A | | 3/1963 | Lewis | |
| 3,439,446 | A | | 4/1969 | Alonso | |
| 4,037,356 | A | | 7/1977 | Chantland | |
| 4,044,499 | A | * | 8/1977 | Toler | 446/242 |
| 4,193,222 | A | | 3/1980 | Deschand | |
| 4,299,394 | A | | 11/1981 | Greenspan | |
| D284,487 | S | | 7/1986 | Pratt | |
| 4,624,648 | A | | 11/1986 | Waters | |
| D330,876 | S | | 11/1992 | Huber | |
| 5,172,510 | A | * | 12/1992 | Lovell, Jr. | 43/42.36 |
| D396,256 | S | | 7/1998 | Shaw | |
| 5,813,931 | A | * | 9/1998 | Gormley | 473/575 |
| 5,890,946 | A | | 4/1999 | Bloomfield | |
| D410,417 | S | | 6/1999 | Hamowy | |
| 5,960,580 | A | * | 10/1999 | Link | 43/42.53 |
| D454,924 | S | * | 3/2002 | Hooten | D21/455 |

* cited by examiner

*Primary Examiner*—Derris H. Banks
*Assistant Examiner*—Urszula M Cegielnik
(74) *Attorney, Agent, or Firm*—Gerald M. Walsh; Kenneth M. Bush; Bush IP Law Group, LLC

(57) ABSTRACT

The streamer toy of the present invention has a weight insertable into a pocket at the head end of the streamer so that the weight is hidden and not noticeable during use. The hidden weight allows a user to whirl the streamer in numerous snake-like attractive and entertaining patterns. The weight is small in size and padded to make the streamer toy safe for use. The pocket has a reinforced opening allowing a swivel to exit the pocket for attachment of a string-like member used to whirl the streamer toy. The padding on the weight restricts the motion of the clip which, in conjunction with the reinforced opening, increases the durability and useful life of the streamer toy.

16 Claims, 3 Drawing Sheets

WHIRLING STREAMER SNAKE TOY

BACKGROUND OF INVENTION

1. Field of the Invention

The present invention relates to a toy of the type whirled about in a circular path on the end of a string-like member, and, more particularly, to a streamer having a padded flexible weight concealed at the head end.

2. Technical Background

Hand-held toys having streamers and designed for whirling through the air are generally known. The streamer is pulled through the air in order to create an attractive whirling pattern that can be made to continually change. These toys provide entertainment to a user and/or an audience.

In order for these toys to function, the head end of the streamer needs to have a weight in order to guide the centrifugal path of the streamer. Known weights have been tubes, balls, air foils, and sacks. These weights are relatively large and are inherently dangerous, particularly with children. In addition, they are complex in structure and detract from the appearance of the streamer as the toy is whirled.

Therefore, what is needed, and not yet available, is a streamer toy with a weight constructed so that the weight is small in size, flexible, padded for safety, and yet not visible or noticeable when the streamer is whirled.

SUMMARY OF THE INVENTION

The present invention is a snake-like whirling streamer toy that can be whirled in the air to create attractive, entertaining, and variable patterns with the streamer. The streamer also makes distinct rustling sounds when whirled. The streamer is particularly attractive because the only element visible during use is the streamer, there being no apparent weight element visible or noticeable at the head end of the streamer. The streamer has a first side, a second side, a head end, and a tail end. A pocket is sewn on the second side at the head end. A small padded weight is inserted into the pocket. The weight has a removable clip attached rotatably to the weight. A swivel is attached to the removable clip and a string-like member is attached to the swivel to whirl the streamer toy in the air. The swivel exits the pocket through a reinforced opening at the head end. The padding constructed around the weight and removable clip is formed so that the removable clip can rotate in a forward direction but not in a backward or side-to-side direction. This padding construction and the reinforced opening in the pocket impart excellent durability and longevity of use to the streamer toy. The streamer can be constructed of various materials, preferably ones which are light weight, durable, and can be hot-cut to eliminate fraying. The small size of the weight plus its padded construction makes the streamer toy safe, even for small children.

An advantage of the streamer toy of the present invention is no visible or noticeable weight at the head end.

Another advantage of the streamer toy of the present invention is a padded construction of a small size weight, which makes the streamer toy remarkably safe, even for small children.

Another advantage of the streamer toy of the present invention is ease, simplicity, and low cost of construction.

Another advantage of the streamer toy of the present invention is durability and longevity of use, without fraying of the streamer.

Another advantage of the streamer toy of the present invention is the ability of the streamer toy to create multiple, variable; attractive patterns in the air easily and safely, even by small children.

Another advantage of the streamer toy of the present invention is that it is lightweight, portable, and can be folded into a compact size, so that it can fit into a pocket, purse, or backpack.

Another advantage of the streamer toy of the present invention is that it makes a distinctive rustling sound when whirled.

Another advantage of the streamer toy of the present invention is that it provides a self directed activity for children and youth.

Another advantage of the streamer toy of the present invention is that it provides a kinetic sculpture with great visual appeal, and can be used by flag corps, dance teams, and the like.

Another advantage of the streamer toy of the present invention is that dramatic displays are possible without the need for cumbersome sticks, poles, or batons.

Another advantage of the streamer toy of the present invention is that it may be used as an exercise aid.

DETAILED DESCRIPTION OF THE PREFERRED EMBODIMENTS

While the following description details the preferred embodiments of the present invention, it is to be understood that the invention is not limited in its application to the details of construction and arrangement of the parts illustrated in the accompanying drawings, since the invention is capable of other embodiments and of being practiced in various ways.

Figure 1:
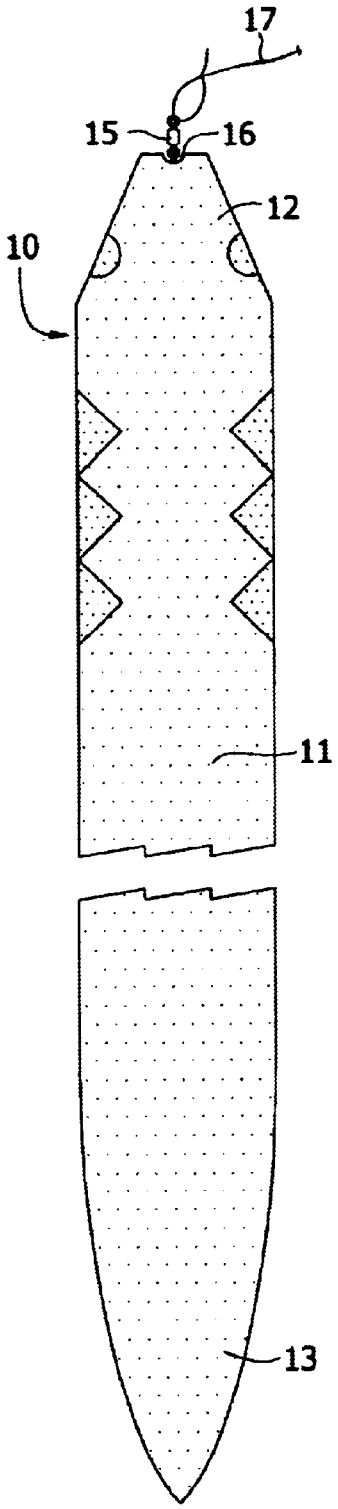
FIG. 1 shows the front of the streamer toy of the present invention.

FIG. 1 shows a front view of the streamer toy 10 of the present invention. Streamer toy 10 has a front side 11, a connecting end 12, and a tail end 13. Also shown is a swivel arrangement 15. Connecting end 12 has a reinforced opening 16 to accommodate swivel 15. A string-like member 17 is attached to swivel 15, which is used to whirl streamer toy 10.

Figure 2:
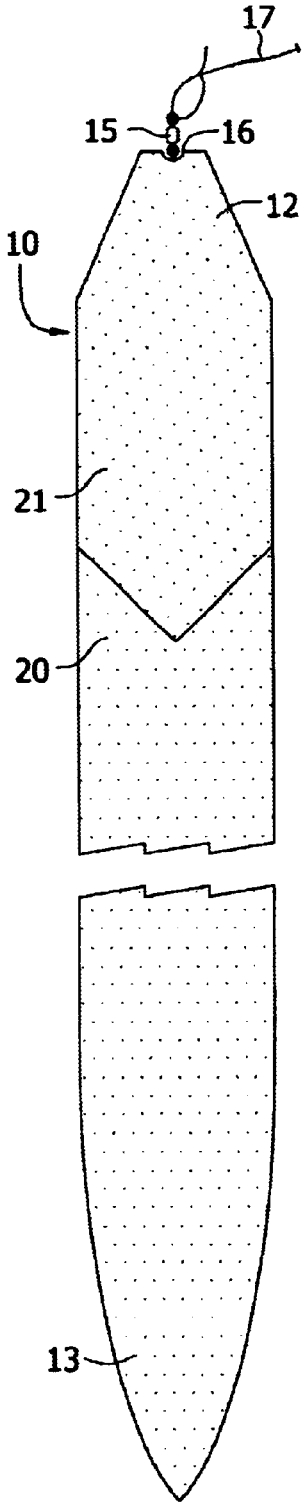
FIG. 2 shows the back of the streamer toy of the present invention.
Figure 4:
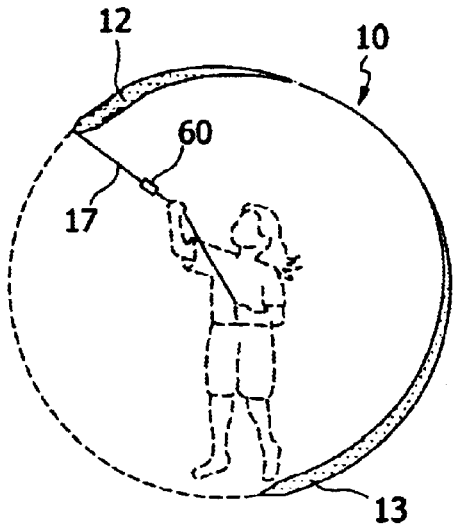
FIG. 4 illustrates the use of the streamer toy of the present invention.
Figure 3:
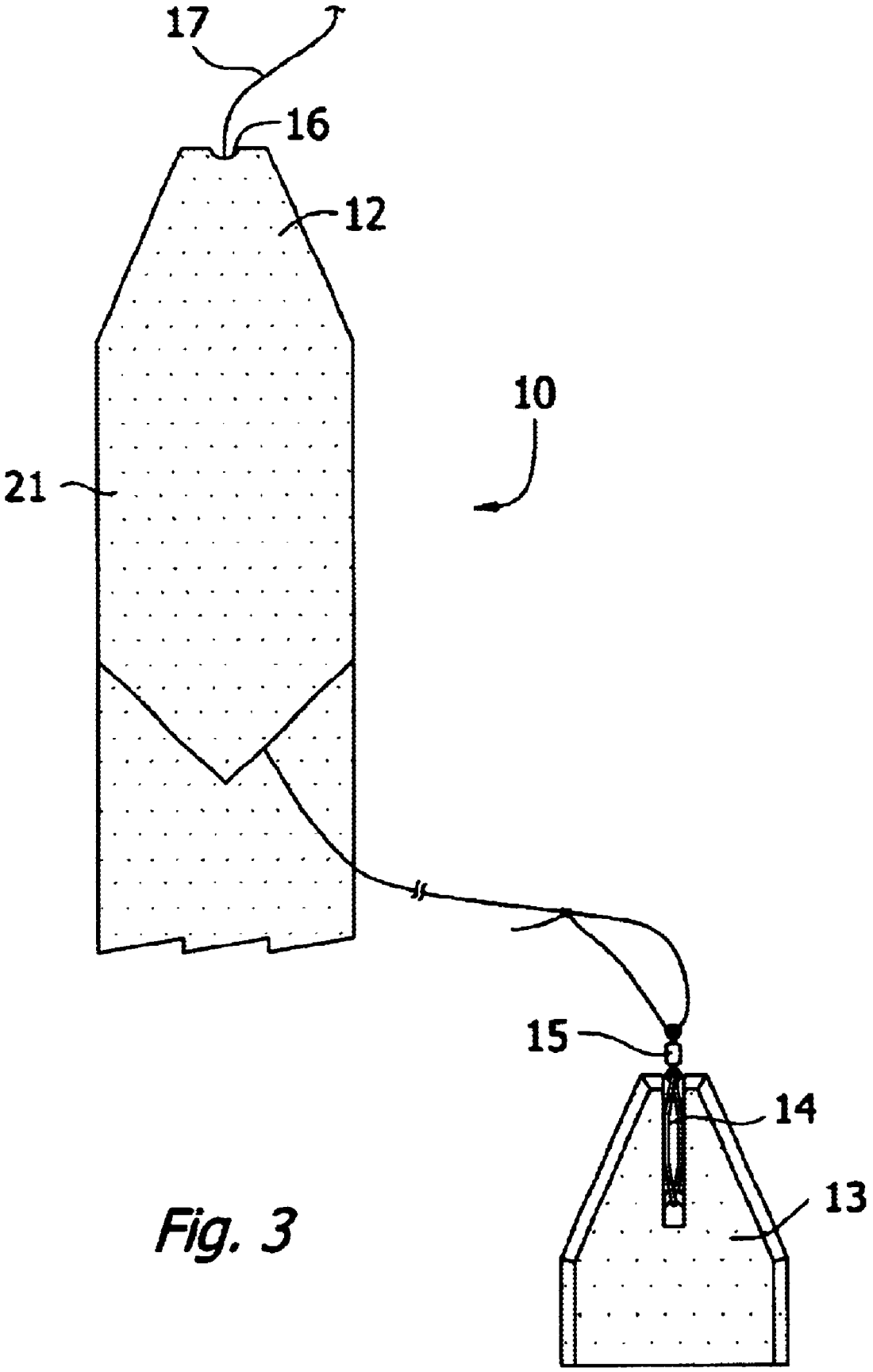
FIG. 3 shows the back, connecting end of the streamer toy of the present invention with the padded weight which fits in the pocket on the back of the streamer toy.

FIG. 2 shows the second side 20 of streamer toy 10 and pocket 21 at connecting end 12. FIG. 3 shows padded weight 30 removed from pocket 21. Also shown is a removable attachment clip 14 attached to padded weight 30, with swivel 15 attached to clip 14. FIG. 4 illustrates the use of streamer toy 10 as it is whirled through the air, creating the appearance of a moving snake.

Figure 5:
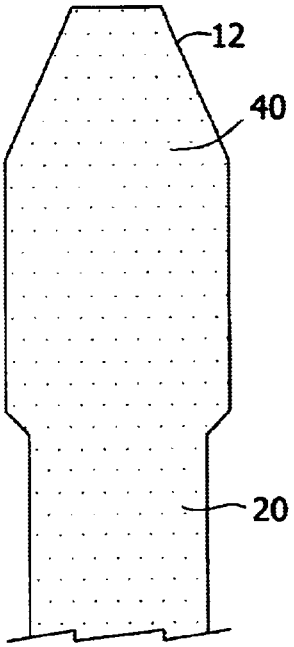
FIGS. 5–7 show elements for the construction of the pocket of the streamer.
Figure 6:
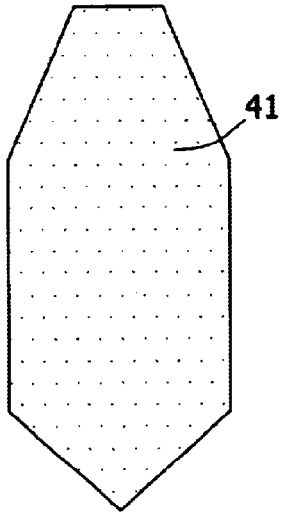
Figure 7:
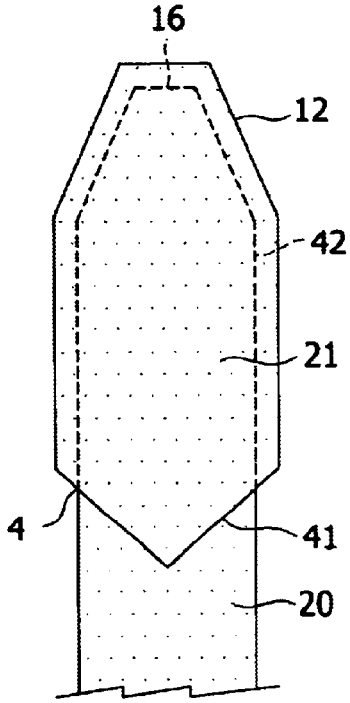

FIGS. 5–7 illustrate how streamer toy 10 is constructed with a pocket 21 having a reinforced opening 16. A first piece 40 is shown in FIG. 5, which comprises the entire streamer 10 without pocket 21. FIG. 6 shows a second piece 41, which is used to create pocket 21. As shown in FIG. 7, second piece 41 is placed on second side 20 of first piece 40 at connecting end 12. Stitching 42 is applied to the sides of pieces 40 and 41, leaving an opening 16 at connecting end 12. This manner of stitching creates a reinforced opening 16, which prevents fraying, and tearing of pocket 21 and opening 16. This aspect of the construction is critical for durability and long term use of streamer toy 10. Connecting end 12 with second piece 41 attached is then turned inside out, after stitching. Pocket 21 may also be constructed from one piece, instead of pieces 40 and 41, by folding over connecting end 12, stitching up the sides, and creating opening 16 using a stitched eyelet hole or grommet.

Figure 8:
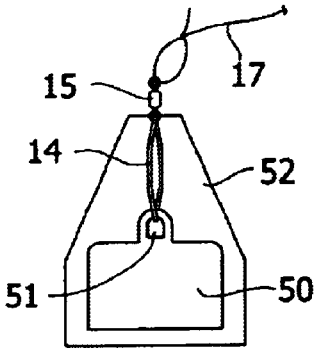
FIGS. 8–9 shows elements for the construction of the padded weight, which fits in the pocket.
Figure 9:
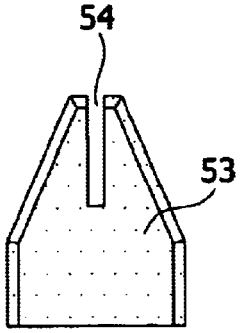

FIGS. 8 and 9 illustrate the construction of the padded weight 13. A weight 50 having an opening 51 is placed on a first padding piece 52. Clip 14 is attached rotatably to weight 50 through opening 51, as shown in FIG. 8. FIG. 9 shows a second padding piece 53, which has an open groove 54 to accommodate clip 14. Second padding piece 53 is placed on top of first padding piece 52 with weight 50 in between padding pieces 52 and 53, and padding pieces 52 and 53 are bonded together.

Figure 10:
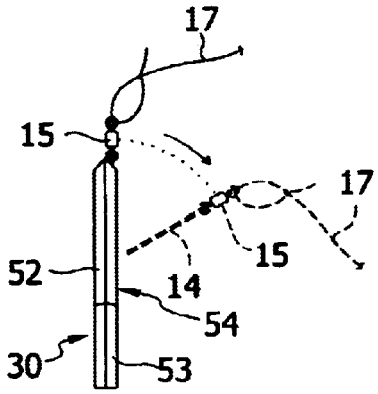
FIG. 10 shows a side view of the padded weight and connecting swivel arrangement.

FIG. 10 shows a side view of padded weight 13 with padding pieces 52 and 53 bonded together. FIG. 10 also shows how clip 14 can articulate forward from front side 54 of padded weight 13, but is restricted from moving in other directions. In other words, clip 14 can move in an out of groove 54 only in one direction. This restricted movement of clip 14 increases the durability and useful life of the streamer toy. In addition, this slotted padding construction allows clip 14 and swivel 15 to be attached to weight 50 after weight 50 is enclosed in padding material.

The streamer is made preferably of 1.5 ripstop nylon, which can be hot cut to prevent fraying. However, the streamer can be made of other materials, such as, for example, polyethylene, vinyl, dacron, silk, cotton, polyester, mylar, paper (including metallic paper), nylon, and the like.

Padding covering the weight 50 is preferably made of flexible foam rubber but can also be made of styrofoam, cotton, cardboard, felt, and the like. Alternately, the weight may be constructed of sand, or similar material, contained in a sack, which can also be inserted into pocket 21.

Swivel 15 can be a typical barrel swivel used in fishing gear, and clip 14 can be a typical safety snap used with a barrel swivel. String-like member 17 can be made of any suitable material, preferably, 150 lb. dacron line. Weight 50 can be made of any suitable material but, preferably, is made of brass of about 1 oz. weight, ranging in weight from about 0.5 to 5 oz. The length of the streamer 10 is about 12 to 144 inches, preferably, about 96 inches. Although only one streamer has been described, a plurality of streamers may be attached to pocket 21, and the term "streamer" encompasses not only one streamer but may also include multiple streamers.

The streamer toy can also be used as a craft toy where it is provided as a kit and can be assembled by a user. In addition, users can then also draw designs and figures of any desired type on the streamer.

Although a pocket construction is preferable, padded weight 30 can be attached directly to connecting end 12, permanently or reversibly, by means known in the art, such as, for example, glue, snaps, rivets, and the like. A clip 14 and swivel 15 are then attached to the weight, and a string-like member 17 is attached to the swivel.

In an alternative embodiment, string-like member 17 can be threaded through a tensioning device 60, such as, for example, a bead tensioner or tube, as is shown in FIG. 4. Tensioning device 60 can adjust the length of string-like member 17 to control the diameter and speed of rotation of the streamer.

The foregoing description has been limited to specific embodiments of this invention. It will be apparent, however, that variations and modifications may be made by those skilled in the art to the disclosed embodiments of the invention, with the attainment of some or all of its advantages and without departing from the spirit and scope of the present invention. For example, the length of streamer 10 may be up to 20 feet or more for adult use. Sound and/or light generating units may be added to the streamer. Weight 50 may be enclosed permanently in pocket 21. Pocket 21 may be also positioned on front side 11. More than one weight can be used, and string-like member 17 can be substituted with a stick, handle, or a rod, or can be attached to a stick, handle, or rod, preferably with another swivel. The pocket 21 may be constructed with glue instead of stitching, or may be formed by heat sealing when using plastic materials.

It will be understood that various changes in the details, materials, and arrangements of the parts which have been described and illustrated above in order to explain the nature of this invention may be made by those skilled in the art without departing from the principle and scope of the invention as recited in the following claims.

I claim:

1. A streamer toy, comprising:

a) a streamer having a first side, a second side, a connecting end, and a tail end;

b) a pocket on said second side at said connecting end;

c) a weight insertable into said pocket;

d) a clip attached to said weight; and e) a swivel attached to said clip.

2. The streamer toy according to claim 1 wherein said pocket has a reinforced opening through which said swivel exits.

3. The streamer toy according to claim 2 further comprising padding covering said weight and said clip, said padding having an opening to permit said clip to rotate in and out of said padding.

4. The streamer toy according to claim 3 further comprising a member attached to said swivel to whirl said streamer toy.

5. The streamer toy according to claim 4 further comprising a tensioning device attached to said member to control the diameter and speed of rotation of said streamer.

6. The streamer toy according to claim 1 further comprising a plurality of streamers.

7. A streamer toy, comprising, a) a pocket, said pocket having a reinforced opening;

b) a weight insertable into said pocket; and c) a clip attached to said weight, said clip having a swivel, said swivel constructed to exit said pocket through said reinforced opening.

8. The streamer toy according to claim 7 further comprising padding covering said weight and said clip, said padding having an opening to permit said clip to rotate in and out of said padding.

9. The streamer toy according to claim 8 further comprising a member attached to said swivel to whirl said streamer toy.

10. The streamer toy according to claim 9 further comprising a tensioning device attached to said member to control the diameter and speed of rotation of said streamer.

11. The streamer toy according to claim 7 further comprising a plurality of streamers.

12. A streamer toy, comprising, a) a streamer having a pocket, said pocket having a reinforced opening;

b) a weight insertable into said pocket, said weight having a clip with a swivel, said swivel constructed to exit said pocket through said opening; and c) padding covering said weight and said clip, said padding having an opening to permit said clip to rotate in and out of said padding in one direction only.

13. The streamer toy according to claim 12 further comprising a member attached to said swivel to whirl said streamer toy.

14. The streamer toy according to claim 13 further comprising a tensioning device attached to said member to control the diameter and speed of rotation of said streamer.

15. The streamer toy according to claim 12 further comprising a plurality of streamers.

16. A streamer toy, comprising:

a) a streamer having a connecting end and a tail end;

b) a weight attached to said connecting end, said weight being padded;

c) a swivel attached to said weight by a clip;

d) a member attached to said streamer toy; and e) a tensioning device attached to said member to control the diameter and speed of rotation of said streamer.

* * * * *